United States Patent [19]

Lane

[11] 4,142,311

[45] Mar. 6, 1979

[54] PERMANENT CALENDAR

[76] Inventor: Ronald S. Lane, 406 Deer Creek Dr., Plainsboro, N.J. 08536

[21] Appl. No.: 798,273

[22] Filed: May 19, 1977

Related U.S. Application Data

[63] Continuation-in-part of Ser. No. 722,925, Sep. 13, 1976, abandoned.

[51] Int. Cl.[2] ..... G09D 3/02

[52] U.S. Cl. ..... 40/107; 40/109; 40/120

[58] Field of Search ..... 40/107, 109, 110, 120, 40/122, 152.1

[56] References Cited

U.S. PATENT DOCUMENTS

| | | | |
|---|---|---|---|
| 247,000 | 9/1881 | Bath | 40/107 |
| 301,553 | 7/1884 | Bereman | 40/109 |
| 1,109,814 | 9/1914 | Bailey | 40/107 |
| 1,427,850 | 9/1922 | Reed | 40/122 |
| 2,992,500 | 7/1961 | Hayhow | 40/120 |
| 3,579,882 | 5/1971 | Miyahune | 40/107 |

*Primary Examiner*—John F. Pitrelli

*Attorney, Agent, or Firm*—Wolder, Gross & Yavner

[57] ABSTRACT

An improved permanent calendar assembly adapted and structured to display any month of any year. As in known calendars of this type, the construction features a flat main body with forwardly protruding tracks for removable mating with date columns. For flexibility of display blocks or end pieces carrying dates "29", "30" and "31" are rotatably or removably mounted onto the date columns. The date mounting structure allows both sides of the blocks to be shown, one side carrying a date and the reverse side being blank.

9 Claims, 16 Drawing Figures

FIG. 1
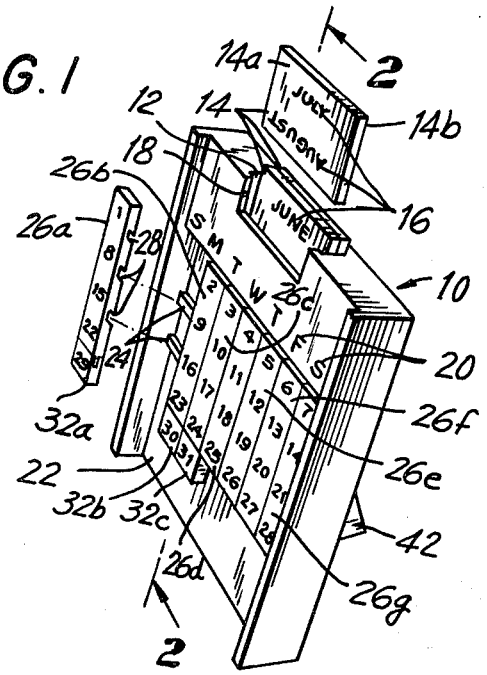
FIG. 2
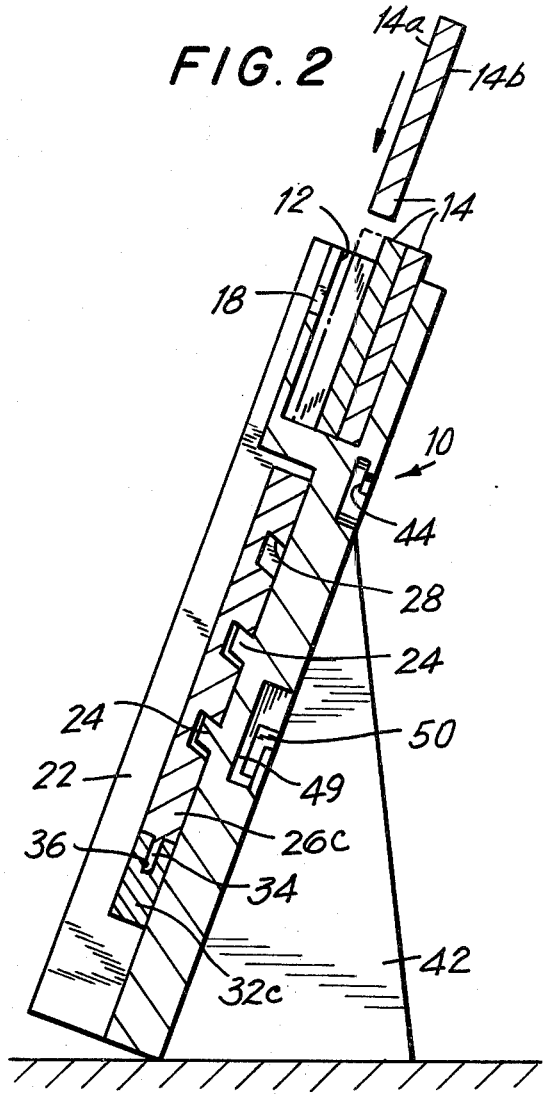
FIG. 3
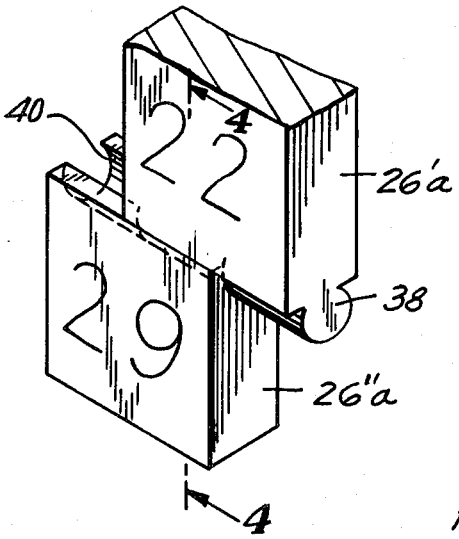
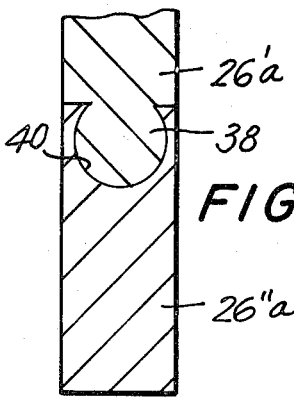
FIG. 4
FIG. 5
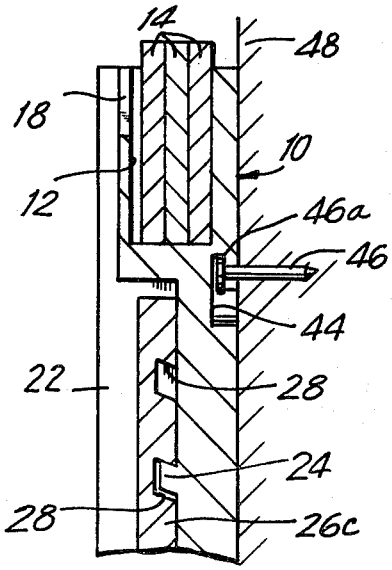

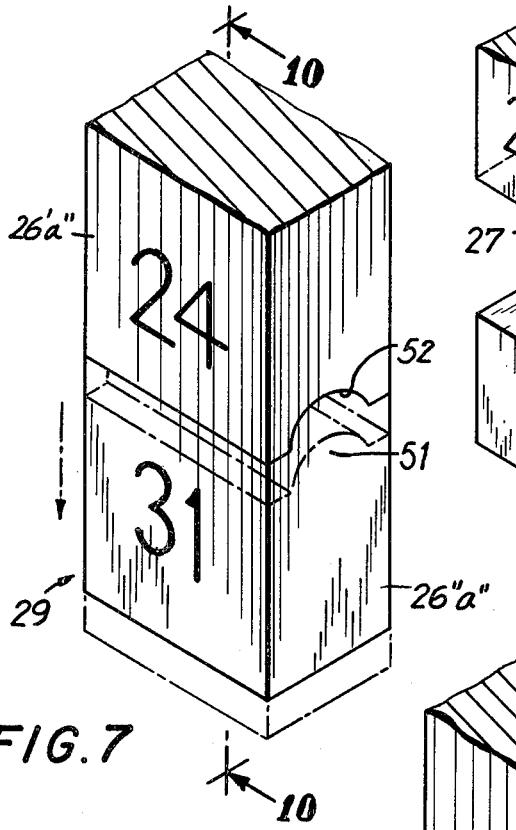
FIG.7
FIG.6
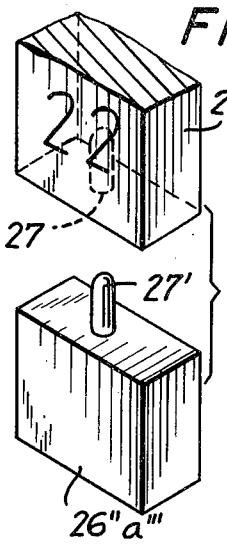
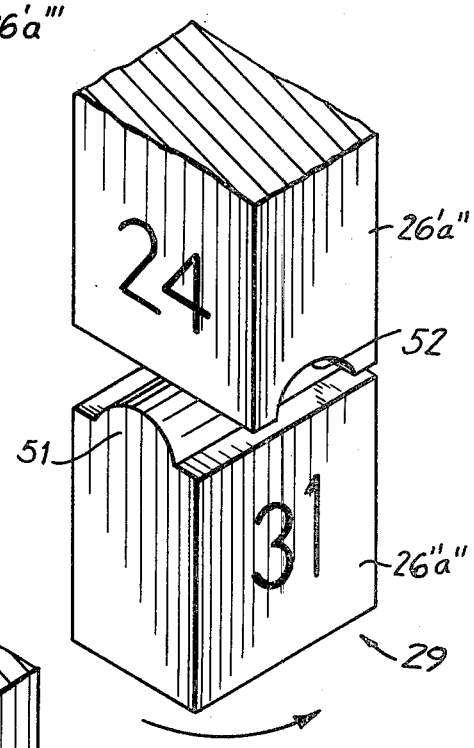
FIG.8
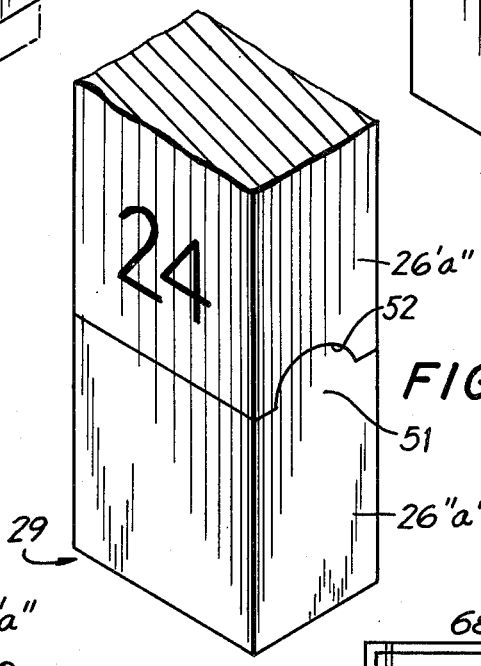
FIG.9
FIG.10
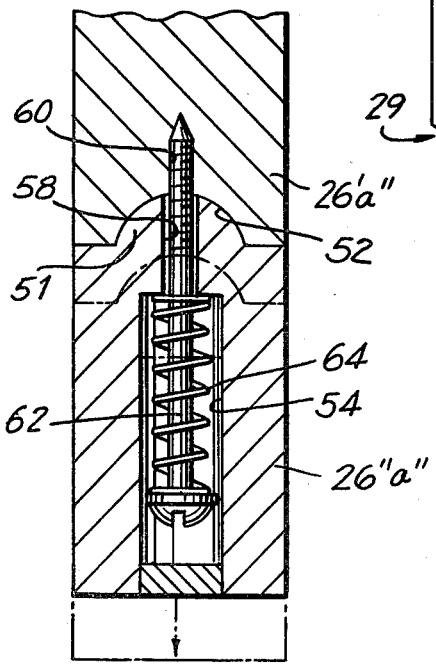
FIG.11
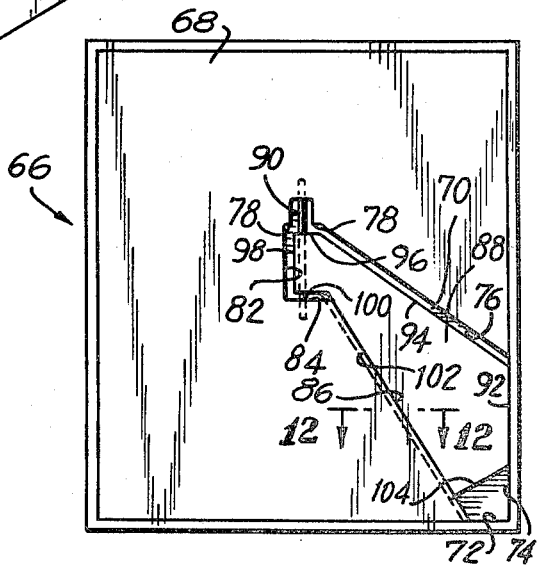

FIG. 13
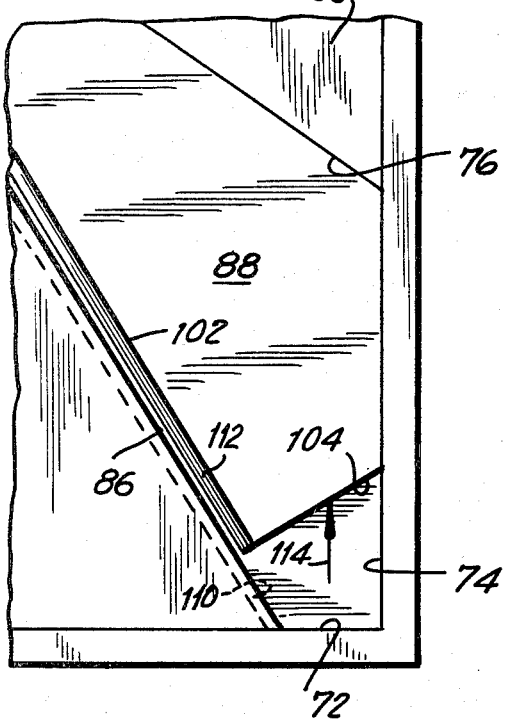
FIG. 12
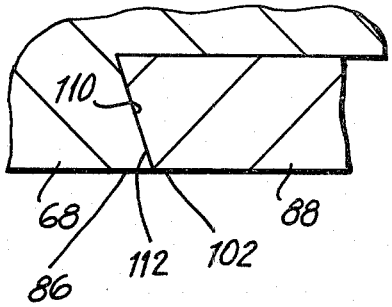
FIG. 15
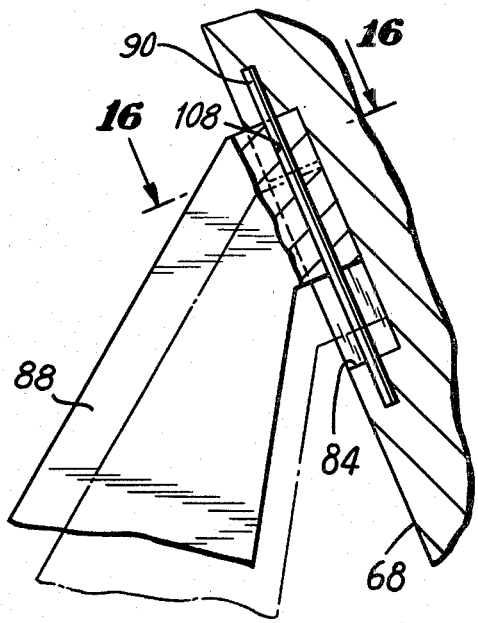
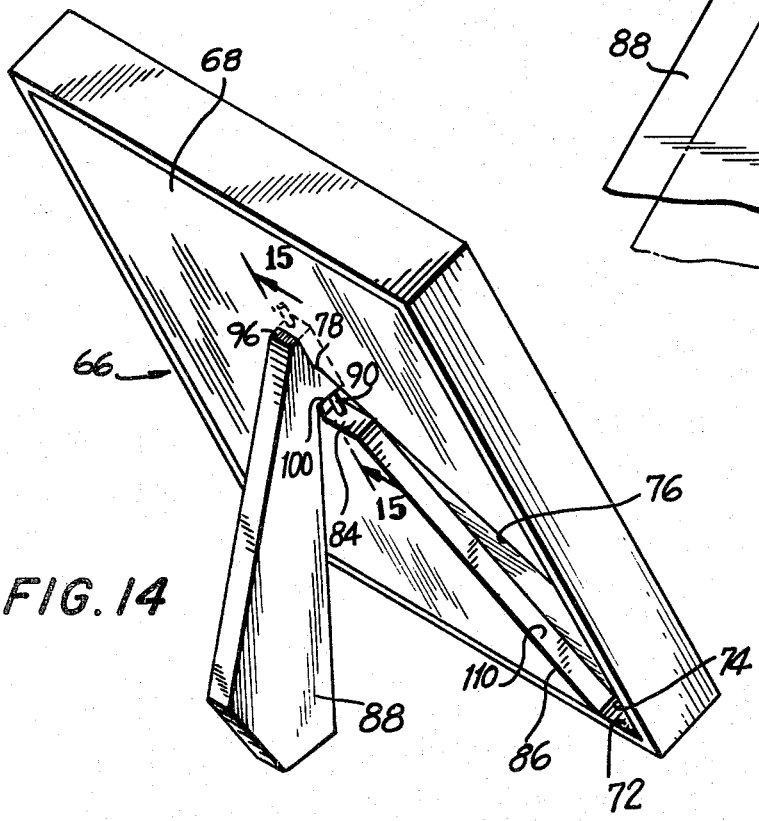
FIG. 14
FIG. 16
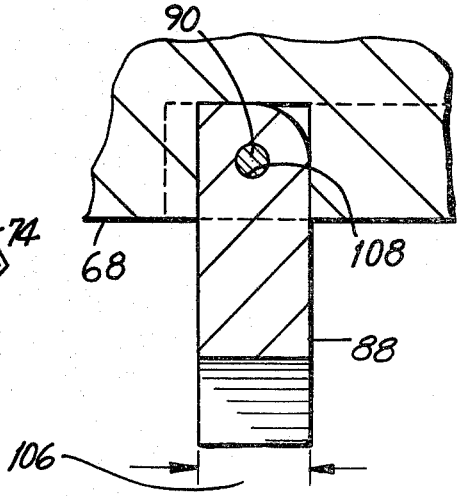

PERMANENT CALENDAR

This application is a continuation-in-part of U.S. patent application Ser. No. 722,925 filed Sept. 13, 1976, now abandoned.

This invention relates primarily to calendar displays and more particularly, to improvements in permanent calendar displays for showing the dates of any month of any year.

Permanent calender displays are well known in the art, and generally can comprise a series of columns that are attached by various means to a flat main body. However, a basic problem contended with by these calendars is the fact that months can be "28", "29", "30", or "31" days long. It is felt these previus attempts to solve this "month-length" problem has left room for improvement.

Another problem contended with these calendars is providing a means of support that permit it both to be hung on a wall or stood on a desk. The support stands may be completely separate members, thus being subject to loss. Or the stands may be swingable members which are attached to the back frame. However, when the calendar is moved and the stand is placed in its stored position against the back wall of the frame, if the frame is held in horizontal position the stand may swing away from the wall and fall loose.

Accordingly, a primary object of the present invention is to provide a calendar structure which solves the month-length problem by means of special pieces rotatably or removably mounted onto the date columns.

Another object of the present invention is to solve the support problem by providing a calendar frame having a permanently affixed swingable stand which may be utilized in "swung-out" position for display purposes on a supporting surface or which may be swung back in and stored in the frame so that the calendar may be hung on a wall.

Still yet another object of the present invention is to provide a calendar frame having a permanently affixed swingable stand mounted within the back wall of the frame so that frame may be moved or stored horizontally without the stand swinging to a hanging position.

Still yet another object of the present invention is to provide a permanent desk calendar which is simple in construction, and yet attractive.

Still a further object of the present invention is to provide a device of the character described which may be manufactured from many different materials and which is durable to a high degree in use.

These and other objects of the present invention are accomplished in preferred and alternative embodiments of the present invention which features a generally flat main body member with forwardly protruding tracks upon which are positioned seven date columns. Means are provided at the bottom of three of the colums to alternatively display either the numerals "29", "30", or "31", or a blank side. The means may be either rotatable or removable reversible blocks. The numerals "29", "30", and "31" may be reversibly but permanently secured to their appropriate date colums. The mounting structure comprises a generally rectangular solid member having approximately the same dimensions as the date column and carrying an upwardly extending portion or ridge received within a mating groove or trough in the appropriate column. The member has a hole drilled therethrough leaving a shoulder at the upper portion. A smaller hole is then drilled through the upper shoulder and into the date column. A screw having a thread to fit the smaller hole is passed into the mounting structure with a compression spring between the lower head of the inner surface of the head and the inner annular surface of the shoulder. The screw is threaded in through the structural member and into the column until the appropriate compressive force is stored in the compression spring. In order to reverse the position of the mounting structure, it is simply necessary to apply a further compressive force on the spring by pulling the mounting structure downward until the ridge is completely removed from the groove, and therefore the mounting structure is able to turn using the screw as its axis and the desired exposed surface, in the usual case the blank surface, is substituted after the structure is rotated 180°. It is obvious that this mounting structure is useful for environments other than attaching this member to a column in a perpetual calendar. An example of another structure would be a member secured to a piece of machinery where it might be important to inform observers that the equipment is on or off.

With respect to the removable, reversible mounting structure, two alternatives are presented. The first of these alternatives uses a circular track and guide and the second uses a rectangular or square track and guide; in both cases, the track being transversely slidable in the guide. Each enables reversal of such numerals to display a blank face.

A third alternative mates such numerals to date columns by a dowel and hole structure to better enable reversal to blank by turning the lowest numeral endpieces.

Furthermore, a support member is provided for the calendar frame consisting of a standard support stand which is rotatably secured to the back plate of a frame, in this case, the frame for the perpetual calendar. The rear wall has a cut-out corresponding in some degree to the stand outline, and has a lower inner bevelled wall corresponding to a lower inner bevelled wall of the support stand. The bottom wall of the stand is spaced from and diagonally above the bottom wall of the cut-out forming a finger recess. In the upper portion a pivot pin is secured to the stand in the wall, the stand pivoting thereabout. Above the stand is a notch in the cut-out and when the user desires to position the stand for support display purposes, a finger is placed in the recess to lift the stand upwardly and disengage the mating bevelled edges of the cut-out and the stand. The stand is then rotated approximately 90° outwardly and then shifted upwardly into the notch, fixedly securing therein for appropriate display. It is also obvious that this support stand can be used for a wide variety of support functions, and is not limited to a support in a perpetual calendar.

Other objects, features and advantages of the present invention will become apparent by reference to the following more detailed description of a preferred, yet illustrative embodiment of the present invention and reference to the accompanying drawings, wherein:

FIG. 1 is an isometric representation of the calendar of the present invention, showing particularly the removable date columns thereof.

FIG. 2 is a sectional view of the calendar of FIG. 1, taken along the line 2—2 thereof, and showing particularly the supports therefor, the month receptacle defined thereby and the mating relationship of the date columns thereto;

FIG. 3 is a partial isometric representation of the removable portion of a date column and its assembly to a date column;

FIG. 4 is a sectional view of the assembly of FIG. 3, taken along the line 4—4 thereof;

FIG. 5 is a partial sectional view similar to part of the representation of FIG. 2 and showing particularly the use of one of the supports for the calendar;

FIG. 6 is a partial isometric representation of an alternative form of the removable portion date column and its assembly to a date column;

FIG. 7 is a partial isometric view of a portion of a date column with a rotatably secured mounting structure thereon;

FIG. 8 is a view similar to FIG. 1 which the mounting structure has been rotated in a clockwise direction a distance of 90°;

FIG. 9 is a view similar to FIGS. 7 and 8 in which the mounting structure has completed a rotation of 180°;

FIG. 10 is a sectional view taken along the line 10—10 of FIG. 7;

FIG. 11 is a rear elevational view showing the position of the support stand when its rests;

FIG. 12 is an enlarged partial sectional view taken along the line 12—12 of FIG. 11;

FIG. 13 is an enlarged view similar to FIG. 11 but showing the position of the stand after a force has been applied against the bottom surface of the stand, thus separating the bevelled edges of the stand and the cutout;

FIG. 14 is a rear perspective view showing the stand in its support position;

FIG. 15 is a partial sectional view taken along the line 15—15 of FIG. 14; and

FIG. 16 is a sectional view taken along the line 16—16 of FIG. 15.

Referring to the drawings, and particularly FIGS. 1 and 2 thereof, an improved calendar according to the present invention includes a generally flat, main body member, generally designated 10, its top portion defining a month receptacle 12 into which is placed a plurality of month display members 14. Each of the month display members displays indicia 16 of two months on each of its sides 18. The said two months are arranged in an upside-down relationship so that only one legible month at a time is displayed through display window 18 of receptacle 12.

Forwardly defined by the main body member 10 are weekday indicia 20 which do not vary in arrangement from week to week or month to month or year to year.

Also defined forwardly of main body member 10 is a date column area 22 into which protrudes a pair of date column tracks 24 onto which are selectively and removably mounted date columns 26*a*, 26*b*, 26*c*, 26*d*, 26*e*, 26*f*, 26*g*. Each date column displays four date indicia, each separated in numerical value from the preceding and succeeding displayed date on that date column by seven. The date columns define rearwardly three open track openings 28, so that at least two positions of height of attachment are within the mating capability of each date column. The preferred method of attachment is illustrated in FIGS. 7–10, where there is shown a date column 26′*a*″ normally ending in the numeral 22, 23 or 24 and to which is secured a rotatable mounting structure 29. The mounting structure consists of a basically rectangular endpiece 26″*a*″ which is essentially of the same external dimensions as the column 26′*a*″. Mounted proximate its top wall is a ridge 51 running the entire length of the structure. In the present embodiment the structure is shown as being circular, although alternatively the structure could be rectangular in cross-section. This structure mates with a groove 52 having a circular-cross section of essentially the same diameter and circumferential dimensions as that of the ridge 51.

As best seen in FIG. 10, the structure 29 has a hole 54 passing upwardly from the lower surface substantially through the entire height of the structure but stopping somewhat short of the top surface of the ridge forming a shoulder 56. Passing upwardly from the ridge is a second hole 58 of lesser diameter having an axis coincident with the axes of first hole 54. A third hole 60 having an axis coincident with the axes of the first and second holes passes into the date column 26′*a*″ for a short distance. A threaded screw 62 is positioned inwardly of hole 54, and maintains a spring 64 under compression between the inner surface of the screw head and the lower surface of the shoulder 56. The threaded portion engages the hole 60 and the screw 62 may be adjusted upwardly to vary the pressure on the compression spring 64 until the desired compressive force is achieved.

It is now obvious that to operate this mounting structure it is simply necessary to apply a downward force on the column and thus withdraw the ridge 51 (see FIG. 10 in phantom) from the groove 52 a sufficient distance so that the endpiece 26″*a*″ may be turned, as shown in FIG. 8, clockwise a distance of approximately 90°. As shown in FIG. 9, by continuing the twisting operation another 90° the blank surface is displayed in the bottom of the date column 26′*a*″ for those days in which there is no succeeding day in the month below the 24th, such as the 31st.

The circular cross-section for the ridge 51 is desirable over, for example, a rectangular cross-section in that the turning can be accomplished even before the structure has been pulled down to completely withdraw the ridge 51 from the groove 52. This adds to the ease of operation of the invention.

It is obvious that this invention is useful for purposes other than just a perpetual calendar, but may be used in any structure in which it is desirable for one reason or another to rotate a member secured to another member, without running the risk of losing the rotatable member. An alternative method of attachment for endpieces 32*a*, 32*b*, 32*c* is shown in FIGS. 1 and 2 to include rectangular or square track 34, protruding downwardly from a date column, and rectangular or square guide 36 defined in the endpiece. The mating of track 34 and guide 36 is with a press fit enabled by their size. Each endpiece is blank on its reverse side so that when it is not necessary to display a numeral, the blank side is displayed. Thus, the endpiece is not lost or easily misplaced, and looks aesthetically pleasing attached to the columns.

Alternatively, another method of attachment is formed by circular track 38 protruding from date column 26′*a*″ and cylindrical guide 40 defined by endpiece 26″*a*″ (FIGS. 3,4).

Yet another alternative embodiment is illustrated in FIG. 6. There is shown column 26′*a*″ having a blind hole 27 to snugly receive an upstanding dowel 27′ centrally mounted on endpiece 26″*a*‴. The endpiece may be twisted to the desired alignment with the column to display either its numeral side or its blank side. The dowel firmly retains the endpiece, discouraging disengagement from the column.

Known means of support for calender 10 is by means of flat, triangular stand 42 and/or rearwardly facing opening 44. A hanging hook 46 (FIG. 5) is used by affixing it to a wall 48 or the like and inserting its head 46*a* into opening 44. In this support configuration, stand 42 is moved to a position where its plane is parallel to the plane of main body member 10. This positional motion is best enabled by hinging stand 42 to the back of member 10 (not shown). Otherwise, stand 42 is removably installed in the perpendicular orientation illustrated in FIGS. 1 and 2 by means of stand opening 49 defined rearwardly of main body member 10 and hook 50 protruding from stand 42.

Turning now to FIGS. 11–16 there is shown a novel type of support stand which is useful not only for the permanent calendar construction mentioned in the present application but for any construction in which it is desired to support a frame by such a support means. Examples would be a frame for a photograph or a support stand for a piece of fine art.

More particularly, FIG. 11 shows a rear elevational view of a frame 66 such as might be used to support a perpetual calendar, or some other object, such as a picture. The frame includes a rear wall 68 having cutout portion 70 defined by a bottom wall 72, and upstanding lower outer wall 74 perpendicular to the bottom wall, an upper outer wall 76 angled diagonally from the wall 74, and a top shoulder 78, angled from the wall 76 and parallel to the wall 72, a notch 80 extending upwardly from the shoulder 78 which is then continued on the other side of the notch, a side wall 82 extending perpendicularly and downwardly from the top shoulder 78, and intermediate bottom wall 84 extending perpendicularly to wall 82, parallel to wall 72 and directed towards wall 74, and thence a lower inner bevelled wall 86 connecting walls 84 and 72.

Mounted within the cutout 70 is the support stand 88, pivotally mounted within the cutout on pivot rod 90. The stand is defined by a lower outer side wall 92, proximate the wall 74; and upper outer side wall 94 proximate the wall 76; a top wall 96 which is parallel to the top shoulder walls 78; a side wall 98 which is parallel to the side wall 82; a bottom, intermediate wall 100 which is parallel to the bottom, intermediate wall 84; and a lower inner bevelled side wall 102 abutting and proximate to the side wall 86. Finally, there is a bottom, slanted wall 104 which is proximate the bottom wall 72 but is in angular relation thereto for the reason hereinafter described.

As seen in FIG. 16 the stand has a thickness 106 which is just slightly smaller than the width of the notch 80 as will be hereinafter described. The stand also has a through bore 108 to receive the pivot 90.

In practice, the support stand normally lies in its closed condition within the cutout 70, and due to gravity the walls 86, 102 are in abutting relationship. Furthermore, because the walls are bevelled or angled, as best seen in FIG. 12, should the frame 40 be held in a horizontal position with the rear facing downwardly, the friction between the diagonal opposing surfaces 110, 112 of the walls 86, 102 is great enough to retain the stand in position within the cutout. This greatly facilitates the use of such a stand and eliminates the problems required by attempting to grab it and hold it up in its folded away condition.

When it is desired to use the stand, a finger is positioned within the space in the cutout between the walls 72, 104, and a force is applied upwardly against the wall 104, as illustrated in FIG. 7 at 114. This lifts the surface 112 away from the surface 110, and lifts the whole stand upwardly on the pivot 90, there being sufficient play between the walls 76, 94 so that the stand may be swung outwardly away from the rear wall and into its normal support position. Then, the stand is moved further upwardly into the notch 80 which is sufficient to snugly receive the stand. This is best illustrated in FIGS. 15 and 16. Then the stand takes the position as shown in FIG. 14, which is the normal support stand position. In order to disengage the stand it is pulled out of the notch with a slight tug and then pivoted, with the stand in a position so that the walls 86, 102 are spaced from each other. Then the stand is dropped so that the surfaces 110, 112 once again contact each other.

Thus there is disclosed a very practical and useful stand.

The feature of the stand and the rotatable, attached mounting structure clearly have value beyond the permanent calender set forth as an illustrative example in this patent application. However, they also greatly enhance the value of the permanent calendar as well.

A series of operational steps will now be described. Assuming the month is June, 1976, the calendar is either supported by stand 88, or stand 42, and then the month display members 14 are arranged in receptacle 12 so that indicia 16 showing "JUNE" is upwardly oriented and forwardly displayed. Other month display members 14 are placed rearwardly of "JUNE" and thereby stored.

Since the first day of June, 1976, is on a Tuesday, the date column 26*a* showing a "1" is placed at the uppermost point of date column area 22 under the weekday indicia 20 designated "T" (for Tuesday). Consecutively, date columns 26*b*, 26*c*, 26*d*, 26*e* are placed at the uppermost points of date column area 22 under the weekday indicia designated "W", "T", "F", "S", respectively. Date columns, 26*f*, 26*g*, are placed under designations "S" and "M" at the beginning of the week, but with single voids left at the top of each of those date columns to denote that no date on those columns occurs during the first calendar week of June, 1976. The arrangement of the three track openings 28 of date columns 26*f*, 26*g*, and the arrangement of tracks 24 enables this configuration.

It is next determined that June, 1976, has only thirty days, so endpiece 32*c*, 26″*a*, 26″*a*′ or 26″*a*″ is rotated or removed from columns 26*c*, 26′*a*, 26′*a*′, or 26′*a* ″ and reversed to its blank display.

The above clearly illustrates a convenient, simple, yet truly permanent calendar structure which may be formed of any one of a number of attractive materials.

I claim:

1. An improved permanent calendar assembly to display any month of the year and reflect the number of days in the desired month, said assembly having a date column area, a plurality of date columns, and means to detachably mate said columns to said date column area, the improvement comprising:

a series of reversible mounting structures secured to the lower end of three of said date columns;

said structures having two sets of opposed surfaces, one set of surfaces being unnumbered, the other set of surfaces having the numerals "29", "30", and "31" placed thereon respectively;

whereby the three specified date columns may have their respective mounting structures easily adjusted to precisely reflect the correct length of a 29, 30 or 31 day month with either the unnumbered surfaces or the surfaces with the appropriate numerals in visual display, the mounting structures being retained in securement to the date columns while said columns hang from the date column area, said mounting structures being uneffected by gravitional slip in the absence of underlying support.

2. The invention according to claim 1, the reversible mounting structures including removable end pieces for carrying said opposed surfaces, and means for reversible securement of said end pieces to said columns.

3. The invention according to claim 2 wherein said means for securement is a circular track and a cylindrical guide for mating with said circular track said guide comprises a dovetail groove.

4. The invention according to claim 2 wherein said means for securement is a rectangular track and a rectangular guide of a size to enable a press fit between said track and said guide.

5. The invention according to claim 2 wherein said means for securement is a centrally located dowel snugly received within a hole said hole and dowel being either alternatively positioned on said column or said end piece.

6. The invention according to claim 1, the reversible mounting structure, including a hole in said mounting structure extending short of the upper surface thereof, a second hole in the upper surface, having an axis coincident with the axis of said first hole but having a lesser diameter, a hole in said column having an axis coincident with said first two holes and having a diameter equal to that of said second hole, a compression spring having an outer diameter approximately equal to that of said first hole and bearing against the shoulder in said mounting structure, and a screw having a head bearing against the other end of said compression spring and having a threaded body engaging the second and third holes, said screw and spring combination having sufficient force to retain said structure in engagement with said display column, and yet being yieldable to allow rotation of said structure around the axis of said screw body, and hence said column, as desired.

7. The invention according to claim 6, the upper surface of said mounting structure having a ridge thereon, the mating surface of said display column having a groove of substantially the same cross-sectional configuration as the ridge to allow a positive mating of said column in said structure and to prevent indiscriminate rotation.

8. The invention according to claim 7, wherein said cross-sectional configuration is rectangular.

9. The invention according to claim 7, wherein the cross-sectional configuration is semi-circular.

* * * * *

UNITED STATES PATENT AND TRADEMARK OFFICE

CERTIFICATE OF CORRECTION

PATENT NO. : 4,142,311

DATED : March 6, 1979

INVENTOR(S) : Ronald S. Lane

It is certified that error appears in the above-identified patent and that said Letters Patent are hereby corrected as shown below:

Claim 2, Line 2, please delete "removable".

Signed and Sealed this

*Third* Day of *July 1979*

[SEAL]

*Attest:*

*Attesting Officer*

LUTRELLE F. PARKER

*Acting Commissioner of Patents and Trademarks*